United States Patent [19]

Jenkins

[11] Patent Number: 4,706,877

[45] Date of Patent: Nov. 17, 1987

[54] WINDOWED MAILER WITH RETURN ENVELOPE FOR REMITTANCE DOCUMENT, HAVING RETURN MAIL-TO ADDRESS EXPOSED BY REMOVAL OF ORIGINAL MAIL-TO LABEL

[75] Inventor: Richard A. Jenkins, Wheeling, Ill.

[73] Assignee: Moore Business Forms, Inc., Glenview, Ill.

[21] Appl. No.: 1,764

[22] Filed: Jan. 9, 1987

[51] Int. Cl.[4] ..... B65D 27/06

[52] U.S. Cl. ..... 229/73; 229/69; 229/92.3

[58] Field of Search ..... 229/69, 73, 71, 92, 229/92.1, 92.3; 283/81

[56] References Cited

U.S. PATENT DOCUMENTS

| | | | |
|---|---|---|---|
| 759,382 | 5/1904 | Klugh | 229/73 |
| 1,173,869 | 2/1916 | Rougeux | 229/73 |
| 2,846,135 | 8/1958 | Hiersteiner | 229/73 |
| 3,273,785 | 9/1966 | Beckman et al. | 229/69 |
| 3,380,648 | 4/1968 | de Lyra | 229/71 |
| 3,472,444 | 10/1969 | Aliff, Jr. et al. | 229/73 |
| 3,498,528 | 3/1970 | Klein | 229/73 |
| 4,055,294 | 10/1977 | Traise | 229/73 |
| 4,102,489 | 7/1978 | Lucas | 229/92.3 |
| 4,380,315 | 4/1983 | Steidinger | 229/73 |
| 4,384,670 | 5/1983 | Dicker | 229/73 |
| 4,418,865 | 12/1983 | Bowen | 229/69 |
| 4,487,360 | 12/1984 | Fisher et al. | 229/73 |
| 4,524,903 | 6/1985 | Uath | 229/73 |
| 4,632,427 | 12/1986 | Angus | 229/69 |

*Primary Examiner*—Willis Little

*Attorney, Agent, or Firm*—Cushman, Darby & Cushman

[57] ABSTRACT

The recipient of a mailer, following pre-printed instructions, severs a marginal portion in order to separate a cover sheet, through a window of which the initial mail-to address label was visible, from a return envelope. The recipient then detaches a remittance document from the separated cover sheet and places it in the return envelope, e.g. together with a bank check or other form of payment, seals the return envelope and peels off the initial mail-to address label, thus exposing the pre-printed return mail to address. The peeled-off label is to be re-applied up in the upper left corner sender's return address position. The initial mail-to address label and the underlying return mail to address may be provided on the respective layers of a so-called piggy-back label.

18 Claims, 8 Drawing Figures

WINDOWED MAILER WITH RETURN ENVELOPE FOR REMITTANCE DOCUMENT, HAVING RETURN MAIL-TO ADDRESS EXPOSED BY REMOVAL OF ORIGINAL MAIL-TO LABEL

BACKGROUND OF THE INVENTION

Forms manufacturers have previously designed and produced mailers which utilize a portion of the form as a return envelope. Upon the face of this envelope two sets of address information are placed in different locations.

1. A mail-to address, imaged by the end user with a computer printer or some other means. When the form is folded one half over the other half, this address is visible via a die cut window covered with a glassine material. This address is positioned in such a manner that it can be read and processed efficiently by USPS equipment.

2. The second address, containing the information for the return of the document and envelope, is pre-printed by the manufacturer or computer-imaged by the end user in such a position that it is lower than and to the right of the first (mail-to) address. This is again to utilize the efficiencies and possible cost-savings of USPS equipment and standards.

In order to achieve these efficiencies, it is extremely difficult to position both addresses so that the original mail-to address is properly positioned, yet does not interfere with processing of the return envelope.

One solution to this concern is the use of a "flip window", i.e. a hinged flap on the half of the form not serving as the return envelope. In its folded-open position, the mail-to address information is computer imaged, then during subsequent processing is "flipped" closed, placing the mail-to address to the back, or outside, of the folded and sealed document, in such a position that it meets USPS standards for efficient processing. The return envelope portion of the form now needs only one set of address information printed thereon—the address to which the return envelope and documents are to be returned. This information can now be positioned so that it, too, meets USPS standards for efficient processing and possible cost savings.

However, use of the flip window on such a mailer can lead to problems if the initial mailing organization which processes the forms for initial mailing does not monitor to make sure that all of the window flaps have been rotated to the desired position for initial mailing, or if these flaps are torn away during the processing.

In addition, the flip window usually is limited by existing maufacturing constraints to a $2\frac{3}{4}$ inch maximum width, which does not allow sufficient space for data entry in a fair number of cases, e.g. where the given and family names of two individuals are to be listed on the name line, or where the street address line must also contain a long building, floor or suite identifier, or more than one of these. During the mailer manufacturing process, the technique currently used for flipping-open the die-cut hinged window flap may take more time than preceding or succeeding steps, so that it acts as a bottleneck on the production line. And, certain types of computer printers may not be able to process the flip windown, due to moving printer elements which may snap or othrwise cause damage to the flip window.

SUMMARY OF THE INVENTION

The recipient of a mailer, following pre-printed instructions, severs a marginal portion in order to separate a cover sheet, through a window of which the initial mail-to address label was visible, from a return envelope. The recipient then detaches a remittance document from the separated cover sheet and places it in the return envelope, e.g. together with a bank check or other form of payment, seals the return envelope and peels off the initial mail-to address label, thus exposing the pre-printed return mail to address. The peeled-off label may be re-applied up in the upper left corner sender's return address position. The initial mail-to address label and the underlying return mail to address may be provided on the respective layers of a so-called piggyback label.

The principles of the invention will be further discussed with reference to the drawings wherein a preferred embodiment is shown. The specifics illustrated in the drawings are intended to exemplify, rather than limit, aspects of the invention as defined in the claims.

DETAILED DESCRIPTION

Figure 1:
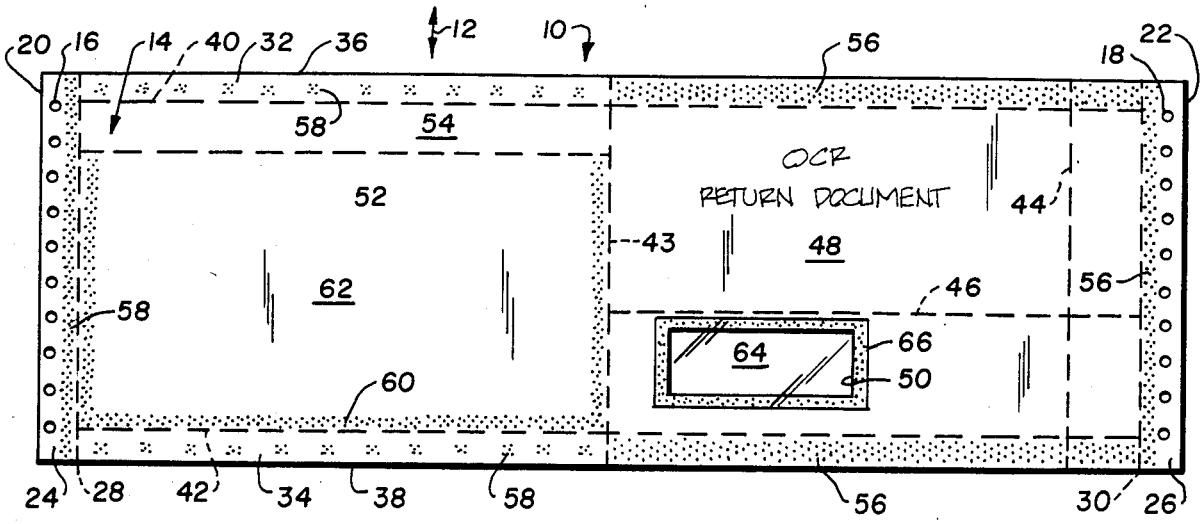
FIG. 1 is a front elevation view of a segment of web stock corresponding to a full width first sheet of one mailer embodying principles of the present invention.

The stock for the mailer of the present invention most advantageously is manufactured out of indeterminate length webs of paper or the like which is furnished to the business or other institution in boxes or rolls containing a succession of serially connected segments, each of which will become an individual mailer. This stock usually has been pre-printed by the form stock manufacturer with most or all of the non-varying information which is to appear on each mailer, and the business or other institution, using a production line which may include a computerized printer, folder, heat sealer and severing device applies the varying information successively to each increment of the stock, including the initial send-to address labels, folds the stock along a longitudinal line and heat-seals the two folded leaves together, and transversally severs the resulting composite into individual mailers ready for mailing. Many variables may be changed without departing from the principles of the invention, e.g. certain businesses or other institutions may wish to obtain the form stock already severed into individual segments, and some may prefer to print the outer layer of the piggyback labels before the labels have been applied to the form stock, either by themselves or by the form stock manufacturer, while others may prefer to print that layer off-line and thereafter apply it to the form stock.

For convenience in description, the preparation and use of a single mailer will be described in detail. However, the description should be understood with the above-mentioned possibilities in mind.

The front of a segment of the first sheet of the form stock is shown in its initial, unfolded condition at 10; the longitudinal direction of the web from which this segment was produced is indicated by the arrow 12.

(The term "front", and other terms, such as "top", "left" and the like are used fairly arbitrarily herein, in reference to the various elements as they happen to be oriented in the drawing figures. No spatial limitation is intended by such reference, unless one appears from the context to be essential for successful use. The face 14 of the segment of the first sheet 10 which has just been designated the "front", is the one which will at a later stage be folded along a longitudinal line to become the inside of the outer wrapper of the mailer.)

The segment 10 is shown made from a full-width web, so that it has a respective row of sprocket-receiving holes 16, 18 bordering its left edge 20 and its right edge 22, each of these rows being segregated onto a marginal strip 24, 26 by a respective longitudinally-running line of weakness 28, 30, e.g. a respective perforation line. Medially, the first sheet 10 is shown provided with a third longitudinal line of weakness 43 (also, and like all of the others which will be described, typically being a line of perforations). In a similar manner top and bottom marginal strips 32, 34 are defined bordering the top and bottom edges 36, 38 of the sheet 10 by respective lines of weakness 40, 42.

The medial line of weakness 43 divides the region of the sheet 10 bounded by the marginal strips 24, 26, 32, 34 into a left half and a right half (or more generically, a "first portion" and a "second portion"). The right half is shown provided with a fourth longitudinal line of weakness 44 and a third transverse line of weakness 46, respectively positioned so as to define, together with the medial line of weakness 43 and the upper marginal strip-defining transverse line of weakness 40, a region 48, which, when later severed along those four lines of weakness will become a remittance document which is tall and wide enough to be read by a standard optical character reader, yet short and narrow enough to fit in the return envelope (to be described) without needing to be folded in either direction.

In relation to the site where the lines of weakness 44 and 46 cross, the potential remittance document 48 occupies the northwestern quadrant. The southwestern quadrant is shown provided with a die-cut window aperture 50 elongated transversally of the web and having a standard size, shape and location. (I.e. on the completed mailer, as seen from the outside, the window 50 will appear at the lower right, at a site suitable for having an address read therethrough by OCR and ZIP+4 automated mail sorting and routing equipment meeting existing USPS standards.)

The first portion, i.e. the left portion of the first sheet 10 is shown additionally provided with a fourth transverse line of weakness 52. It is spaced below the upper marginal strip-defining transverse line of weakness 40 by a small distance sufficient to define a discard strip 54, which the user will later tear off in order to expose the glued side of the return envelope glue flap (to be described), for folding down over the mouth of the envelope which mouth will be in part defined by the edge created at 52 when the discard strip 54 is torn off.

The right portion of the sheet 10 is shown provided on the top, right and bottom marginal strips with a medially-open, squared C-shaped band 56 of heat sealable adhesive. (This will be activated at a later stage (to be described) to close the folded form stock on itself to complete an individual mailer.)

The left portion of the sheet 10 is shown provided with two squared C-shaped bands of adhesive e.g. hot melt adhesive, including a first medially-open band 58 provided on the upper, left and lower marginal strips, and a second upwardly-open band 60 provided about the perimeter of the return envelope rear panel 62 which is delimited by the medial line of weakness 43, the lower marginal strip-defining line of weakness, and the potential return envelope mouth-defining line of weakness 52. (The outer band 58 will be used by the forms manufacturer to marginally plate a second sheet (to be described) to the first sheet, and the inner band 60, which is embraced by the outer band, will be used by the forms manufacturer to marginally secure three margins of the front panel of the return envelope portion of the second sheet to the first sheet, as will be described.)

In some instances, it will be acceptable for the window aperture 50 to remain open. In others, it is preferable or essential, whether for security, or for avoidance of processing problems that the window aperture 50 be glazed, e.g. by a patch 64 of glassine or other transparent or translucent flexible sheet material, e.g. perimetrically glued by a band of adhesive 66 to the sheet 10, e.g. using the same type of adhesive as is used at 58, 60, the window in such an instance being glazed prior to application of the glue band 56 in order to avoid prematurely heat activating the latter while glazing the window 50.

Figure 2:
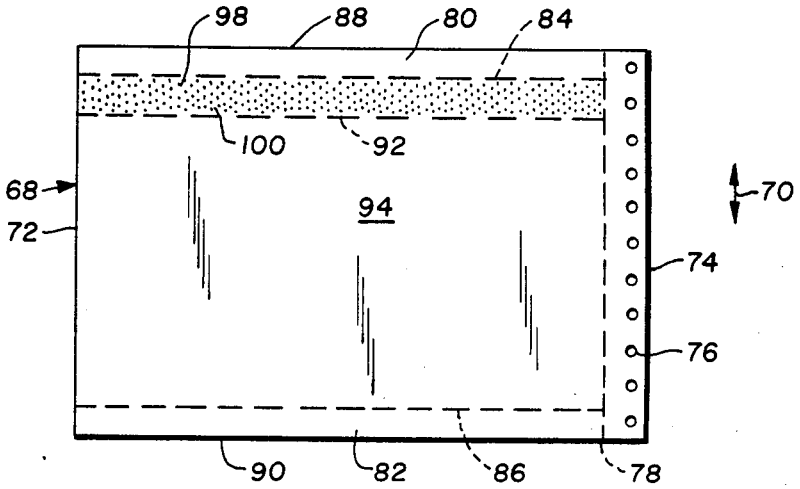
FIG. 2 is a rear elevational view of a segment of web stock corresponding to a narrow width second sheet of the one mailer.

FIG. 2 depicts a rear elevational view of a second sheet 68 for the mailer, this sheet being constituted by a respective segment of a web having a longitudinal direction indicated by the arrow 70. The second sheet 68 is as tall as, but only half as wide as the first sheet 10. It is designed to be superimposed on the first sheet 10 so that one marginal edge 72 coincides with the medial line of weakness 43 and the other marginal edge 74 coincides with a marginal edge of the first sheet 10. (It should be borne in mind that FIGS. 1 and 2 show the faces of the two respective sheets which will confront one another as the form stock is manufactured. Accordingly, the terms "left" and "right" are used in regard to the second sheet consistently with the FIG. 1 and 4 orientations of the second sheet, rather than with the orientation which is shown in FIG. 2.)

The second sheet 68 is shown provided with a row of sprocket holes 76 on its left marginal strip, which is delimited by a longitudinal line of perforations 78. Top and bottom transverse marginal strips 80, 82 are delimited by respective transverse lines of perforations 84, 86 and top and bottom edges 88, 90. All of the foregoing features are sized and placed to correspond thicknesswise of the form stock with the corresponding features of the left portion of the first sheet 10 as depicted in FIG. 1.

In addition, the second sheet 68 is shown provided with a transverse line of weakness 92 which divides the panel 94 which will form the front panel of the return envelope from the strip which will form the fold over and seal glue flap 98 of the return envelope. The glue flap 98 is shown provided on its rear face with a transversally extending band of rewettable adhesive 100.

Figure 4:
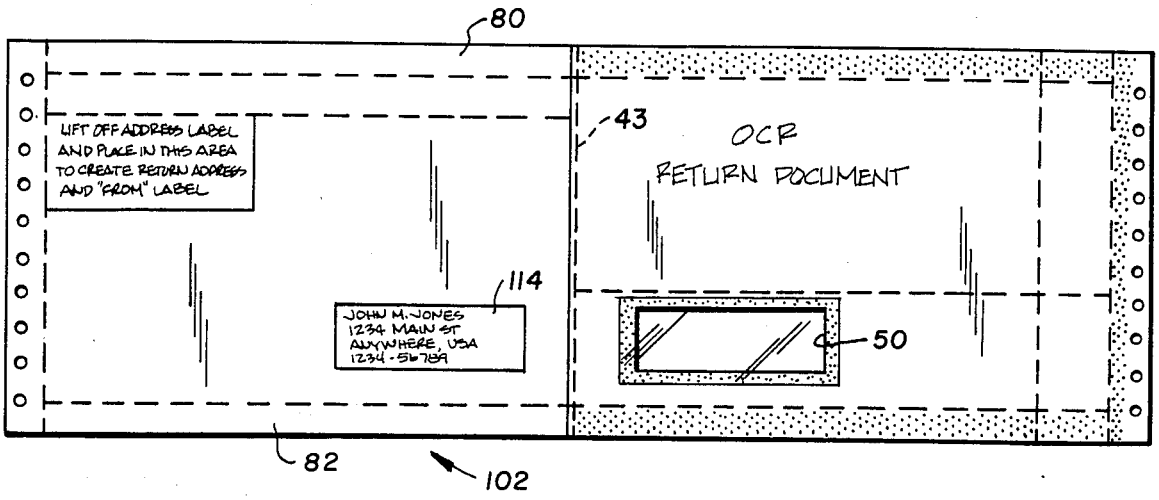
FIG. 4 is a front elevation view of a not-yet-folded mailer created by assembly of the components shown in FIGS. 1–3, with variable data imaged by the mailer's computer printer.

The first and second sheets of the form stock are plated together to produce the composite 102 shown in FIG. 4, by registering the second sheet with the left portion of the first, and pressing the two together while the hot melt adhesive of the bands 58, 60 is in a heat-activated state.

Figure 3:
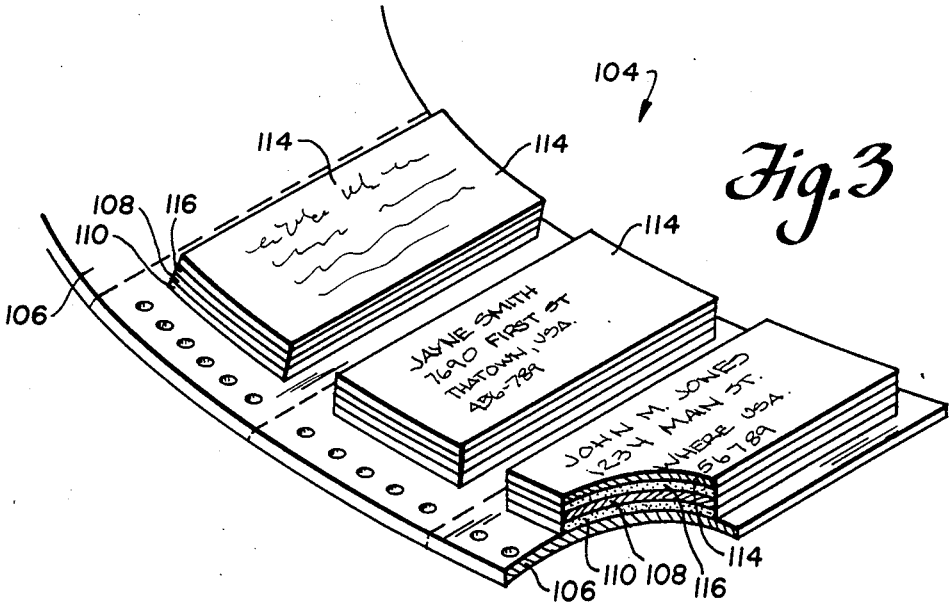
FIG. 3 is a fragmentary front elevational view of a roll of piggyback label stock on which the liners have been pre-printed with a return mail-to address, and the removable top labels will be later variably printed with a series of intended recipient addresses for an initial mailing.

Piggyback label stock is depicted at 104 in FIG. 3. This typical stock includes a backing sheet 106 which bears in a single row a series of liner labels 108 which have a pressure senstive adhesive 110 on the back, which is easily stripped from the backing sheet 106, and the outer surface of which itself bears a coating from which outer labels may be stripped. This preliminary product may be run through a printing and assembling process by the form stock manufacturer in order to apply a printed return send-to address 112 on each liner label 108, and to apply to the outer surface of each thusly printed liner label a blank cover label 114, which is pressure-sensitive adhesively backed, as at 116 with an adhesive which is removable from the outer surface of the respective preprinted liner label without damaging the return send-to address as it appears on that liner label.

(As an alternative, the forms manufacturer may print the return send-to address directly on the front of the return envelope front panel, and use label stock which is similar to that which has just been described, except that the liner label is simply a transparent or translucent liner which can be adhered to the return envelope front panel so as to overlay the pre-printed return send-to address. Yet other variations will occur to those skilled in the art.)

The business or other institution which is the forms manufacturer's customer receives the product which is illustrated in FIG. 4 with the piece of label stock 104 already in place.

The business or other institution variably prints on the face of the composite form that is exposed in FIG. 4, e.g. to apply data relating to transactions in a particular account of a particular intended recipient and to apply to the outer label 114 the name and address of the intended recipient who is responsible for the particular account, i.e. the initial send-to address. (As explained above, this is done with the label stock already affixed by the manufacturer, as shown in FIG. 4.

Figure 5:
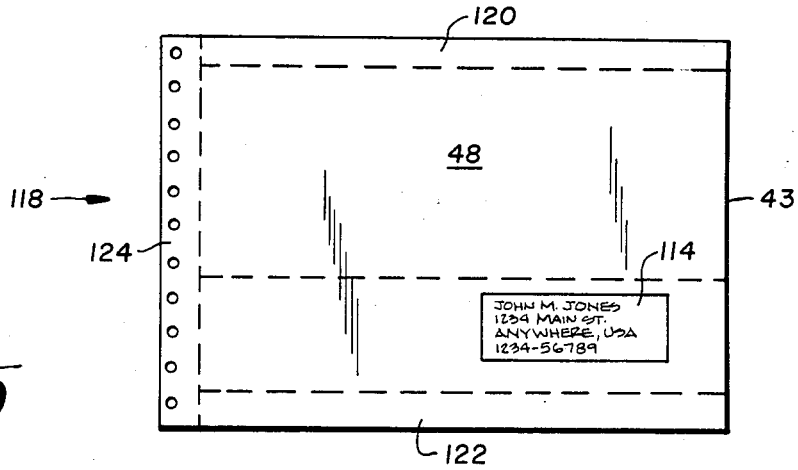
FIG. 5 is a front elevation view of the imaged, folded and sealed mailer having the initial mail-to address showing through the glassine-glazed window aperture.
Figure 7:
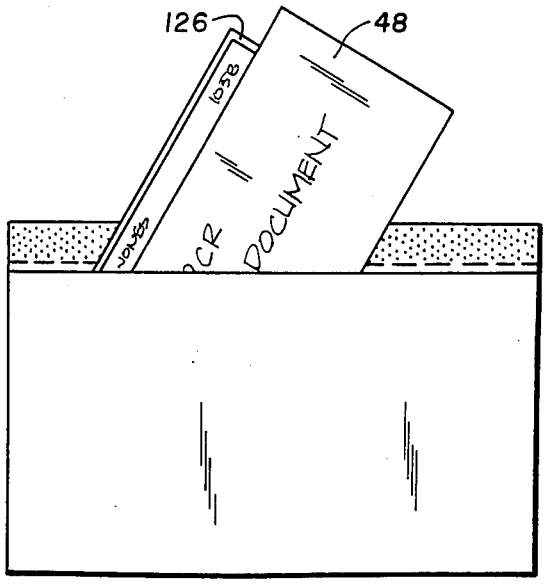
FIG. 7 is a rear elevational view of the return envelope with the remittance document and a form of payment being tucked into the pocket of the envelope so the glue flap can be folded over and sealed closed.
Figure 6:
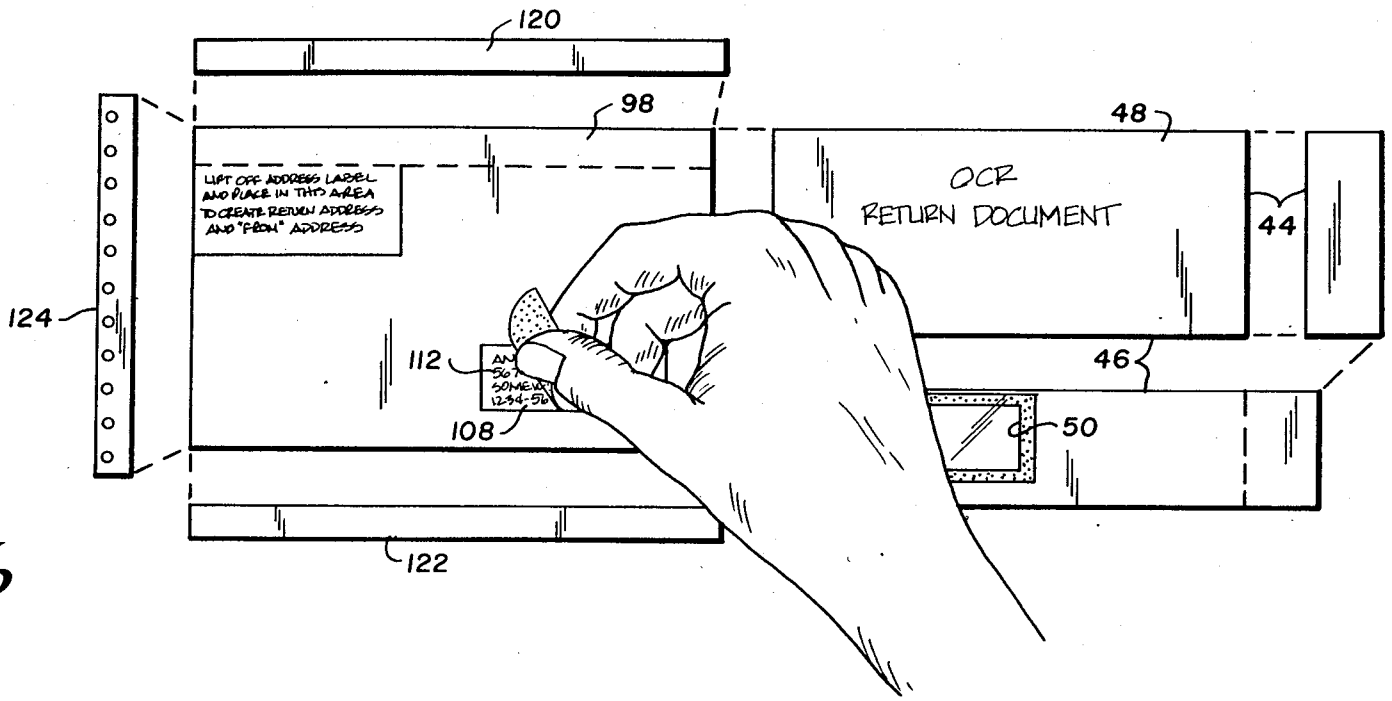
FIG. 6 is a perspective view of the mailer as opened in accordance with instructions, the user having detached the OCR-readable remittance document and being in the process of peeling-off the label bearing the initial send-to address, in order to expose the return send-to address.
Figure 8:
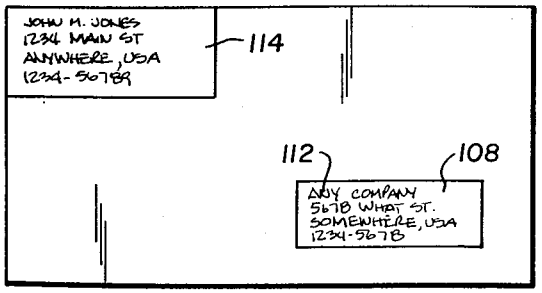
FIG. 8 is a front elevational view of the return envelope ready to be mailed to the return send-to address.

In any event, after the form stock, including the outer labels have been variably printed, the form stock is doubled over on itself, run through a heat sealer and hot pressed therein to produce closed and sealed mailers 118. If, at this stage, the mailers are still serially connected in composite web form, they are serially severed to cause them to become individual mailers ready to be mailed to the initial send-to addressees, the addresses for whom are visible through the respective windows 50 (FIG. 5).

Upon receipt of a mailer 118, the user opens it, in accordance with instructions printed on its outside, by severing the top, bottom and left composite marginal strips 120, 122, 124 along the respective superimposed lines of weakness, 'butterflies' the mailer to an open condition about the medial line of weakness 43, and severs the mailer into two parts along this line of weakness. Next, continuing to follow instructions printed on the mailer, the user severs the OCR-readable remittance document 48 from the discardable remainder of the respective mailer part along the lines of weakness 44, 46, fills in any data (such as the amount of payment being enclosed) called for on the remittance document and prepares a form of payment such as a bank check 126 to return to the sender with the completed remittance document.

As to the other part of the mailer, in order to create a return mailing, the user, following printed instructions, severs the discard strip 54 along the lines of weakness 52, peels off the initial send-to outer address label 114, moves it over and reapplies it in the place marked at the upper left corner of the front panel of the return envelope and presses it in place as a pre-printed return address. Finally, the user inserts the remittance document 48 and the form of payment 126 in the return envelope 128, wets the glue 100, and folds over the flap 98 about the line of weakness 92 and seals it to the outside of the rear panel of the return envelope. The return envelope now automatically bears exposed on its front panel, at a site prescribed for automated processing, the return send-to address.

Although the construction which has been illustrated is preferred, a similar mailer could be prepared using three sheets, the outer two of which are secured along the margin corresponding to the folded line of weakness 43, by a band of glue provided between corresponding marginal extensions of these two sheets, by two bands of glue provided between corresponding marginal extensions of these two sheets and a corresponding marginal extension of the inner sheet. The mailer in either form may be provided with one or more enclosed sheets.

To reiterate in summary form, and in other words, in manufacturing the mailer, a sheet is provided, intended to be later folded along a vertical line midway between the left and right ends. A second sheet is provided, which overlies the left-hand one-half of the bottom sheet. A peel-off label is attached to the top surface of the second sheet in the lower right-hand quadrant thereof. This label bears the name and address of the person who is to receive the mailing piece. The name and address of the return addressee is printed under the label.

The right-hand half of the bottom sheet is provided with a window which is positioned to expose the label when the right half of the bottom sheet is folded over the top of the second sheet. In this way an outgoing mailer is provided with the name and address of the original addressee visible through the window.

Upon receipt, the original addressee removes the top sheet of the envelope as received. This top sheet was originally the right half of the bottom sheet. The addressee is now left with a return envelope, which consists of the left half of the bottom sheet, and the second sheet.

To use the return envelope, the label is peeled off from its original position and reapplied to the upper left-hand quadrant of the second sheet (now the front of the return envelope). Removal of the label from its original position discloses the name and address of the party now to receive the envelope. Moreover, the label now serves to disclose the address of the sender.

In some instances, the return envelope is required to be returned to more than one address, i.e. to individual branch locations, or to subscribers of a billing service which prepared the original mailing. In order to satisfy such needs, the mailing organization can computer print the mail-back-to address on the face of the return envelope in a position which is the same longitudinally as the label, but horizontally to the left of the affixed label. In such instances, the label configuration shown in FIG. 4 will contain only one label, with its corresponding liner and adhesive. Onto this label the address of the original recipient will be computer printed by the mailing organization. The recipient will peel this label off, and reapply it to the portion of the envelope serving as a Return Address Area.

It should now be apparent that the windowed mailer with return envelope for remittance document, having return mail-to address exposed by removal of original mail-to label as described hereinabove, possesses each of the attributes set forth in the specification under the heading "Summary of the Invention" hereinbefore. Because it can be modified to some extent without departing from the principles thereof as they have been outlined and explained in this specification, the present invention should be understood as encompassing all such modifications as are within the spirit and scope of the following claims.

What is claimed is:

1. A mailer, comprising:

two outer sheet means initially joined to one another about at least two opposite ones of four corresponding marginal edges of each, and an inner sheet means sandwiched between said two outer sheet means and initially joined to one of said two outer sheet means along three corresponding marginal edges to define a potential return envelope;

the other of said two outer sheet means including a fully cut-out window aperture;

an initial mail-to address printed on an outer label and removably adhered by reusable adhesive means to a liner means in turn mounted to said inner sheet means with said initial mail-to address disposed in registration with said window aperture so as to be readable therethrough.

2. The mailer of claim 1, further including:

means provided about all four marginal edges of said two outer sheet means for severance to detach said other outer sheet means from said potential return envelope, while leaving said one outer sheet means and said inner sheet means of said potential return envelope joined along said three corresponding marginal edges thereof.

3. The mailer of claim 2, further including:

a return send-to address applied on said inner sheet means in underlying relationship to said outer label, said return send-to address being adapted to become exposed upon removal of said outer label.

4. The mailer of claim 3, wherein:

said outer label is adapted by said reusable adhesive means to be re-applied to said inner sheet means, in region denoted by pre-printed indicia, as a sender's return address label for the potential return envelope.

5. The mailer of claim 3, wherein:

said return send-to address is printed on said liner means and said liner means is adhered to said inner sheet means.

6. The mailer of claim 3, wherein:

said inner sheet means includes along a fourth marginal edge thereof a fold-over and seal glue flap.

7. The mailer of claim 3, wherein:

said window aperture is glazed by transparent or translucent flexible sheet means.

8. The mailer of claim 3, wherein:

said two outer sheet means are adhesively joined to one another along three corresponding marginal edges of each, and are integrally hingedly joined to one another along a fourth corresponding marginal edge of each.

9. The mailer of claim 8, wherein:

said two outer sheet means are provided in common with a line of weakness along said fourth marginal edge of each.

10. Mailer stock, comprising:

two outer sheet means intially joined to one another along one of four corresponding marginal edges thereof and being foldable along said one marginal edge to provide a doubled-over sheet means;

said outer sheet means being provided marginally of the respective three other marginal edges thereof with means for joining said marginal edges to one another, in pairs of corresponding edges, after said two outer sheet means have been folded along said one marginal edge;

an innner sheet means superimposed on one of said two outer sheet means and arranged to become sandwiched between said two outer sheet means as said two outer sheet means are folded along said one marginal edge of each, said inner sheet means being initially joined to said one of said two outer sheet means along three corresponding marginal edges of each to define a potential return envelope;

the other of said two outer sheet means including a fully cut-out window aperture;

an initial mail-to address label adapted to have an initial mail-to address printed thereon, this label being removably adhered by resuable adhesive means to a liner means which is in turn adapted to be mounted to said inner sheet means in such a location as to place an initial mail-to address, when applied to said initial mail-to address label in registration with said window aperture upon folding and joining of said two outer sheet means respectively along said one marginal edge and three other marginal edges of each.

11. The mailer stock of claim 10, further comprising:

means provided about all four marginal edges of said two outer sheet means for severance to detach said other outer sheet means from said potential return envelope, while leaving said one outer sheet means and said inner sheet means of said potential return envelope joined along said three corresponding marginal edges thereof.

12. The mailer stock of claim 11, further including:

a return send-to address applied on said inner sheet means in underlying relationship to said outer label, said return send-to address being adapted to become exposed upon removal of said outer label.

13. The mailer stock of claim 12, wherein:

said outer label is adapted by said reusable adhesive means to be re-applied to said inner sheet means, in region denoted by pre-printed indicia, as a senders's return address label for the potential return envelope.

14. The mailer stock of claim 12, wherein:

said return send-to address is printed on said linear means and said liner means is adhered to said inner sheet means.

15. The mailer stock of claim 12, wherein:

said inner sheet means includes along a fourth marginal edge thereof a fold-over and seal glue flap.

16. The mailer stock of claim 12, wherein:

said window aperture is glazed by transparent of translucent flexible sheet means.

17. The mailer stock of claim 12, wherein:

said two outer sheet means are adapted by a C-shaped band of adhesive applied to at least one of them to be adhesively joined to one another along three corresponding marginal edges of each, and are integrally hingedly joined to one another along a fourth corresponding marginal edge of each.

18. The mailer stock of claim 17, wherein:

said two outer sheet means are provided in common with a line of weakness along said fourth marginal edge of each.

* * * * *